US012359332B2

(12) United States Patent
Brunner et al.

(10) Patent No.: US 12,359,332 B2
(45) Date of Patent: Jul. 15, 2025

(54) COPPER ELECTROPLATING BATH

(71) Applicant: Atotech Deutschland Gmbh & Co. KG, Berlin (DE)

(72) Inventors: Heiko Brunner, Berlin (DE); Sandra Heyde, Berlin (DE); Peter Haack, Berlin (DE); Angela Llavona-Serrano, Berlin (DE)

(73) Assignee: Atotech Deutschland GmbH & Co. KG, Berlin (DE)

( * ) Notice: Subject to any disclaimer, the term of this patent is extended or adjusted under 35 U.S.C. 154(b) by 446 days.

(21) Appl. No.: 18/002,918

(22) PCT Filed: Jun. 29, 2021

(86) PCT No.: PCT/EP2021/067788
§ 371 (c)(1),
(2) Date: Dec. 22, 2022

(87) PCT Pub. No.: WO2022/002899
PCT Pub. Date: Jan. 6, 2022

(65) Prior Publication Data

US 2023/0313401 A1 Oct. 5, 2023

(30) Foreign Application Priority Data

Jun. 29, 2020 (EP) ..... 20182963

(51) Int. Cl.
*C25D 3/38* (2006.01)
*C25D 5/02* (2006.01)

(52) U.S. Cl.
CPC ..... *C25D 3/38* (2013.01); *C25D 5/02* (2013.01)

(58) Field of Classification Search
None
See application file for complete search history.

(56) References Cited

U.S. PATENT DOCUMENTS

| | | | | |
|---|---|---|---|---|
| 5,976,341 | A | 11/1999 | Schumacher et al. | |
| 6,099,711 | A | 8/2000 | Dahms et al. | |
| 9,551,080 | B2 | 1/2017 | Brunner et al. | |
| 11,066,553 | B2 | 7/2021 | Brunner et al. | |
| 2004/0187731 | A1 | 9/2004 | Wang et al. | |
| 2009/0205969 | A1 | 8/2009 | Jimenez et al. | |
| 2014/0138252 | A1 | 5/2014 | Dambrowsky et al. | |
| 2015/0299883 | A1* | 10/2015 | Brunner | C25D 3/38 205/297 |
| 2018/0223442 | A1 | 8/2018 | Brunner et al. | |

FOREIGN PATENT DOCUMENTS

| | | | |
|---|---|---|---|
| CN | 201406999 | A | 2/2010 |
| EP | 2698449 | A1 | 2/2014 |
| TW | 201920358 | A | 6/2019 |
| WO | 2007025606 | A1 | 3/2007 |
| WO | 2011029781 | A1 | 3/2011 |

OTHER PUBLICATIONS

PCT/EP2021/067788; International Search Report and Written Opinion of the International Searching Authority dated Aug. 30, 2021.

* cited by examiner

*Primary Examiner* — Louis J Rufo
(74) *Attorney, Agent, or Firm* — Renner, Otto, Boisselle & Sklar, LLP

(57) ABSTRACT

The invention relates to aqueous acidic plating baths for electrodeposition of copper and copper alloys in the manufacture of printed circuit boards, IC substrates, semiconducting and glass devices for electronic applications. The plating bath according to the present invention comprises copper ions, at least one acid and an ureylene polymer. The plating bath is particularly useful for filling recessed structures with copper and build-up of pillar bump structures.

15 Claims, No Drawings

COPPER ELECTROPLATING BATH

This application is a national phase of International Application No. PCT/EP2021/067788, filed 29 Jun. 2021, which claims priority to European Patent Application No. 20182963.7, filed 29 Jun. 2020, each of which is hereby incorporated herein by reference in its entirety.

FIELD OF THE INVENTION

The invention relates to a plating bath for electrodeposition of copper or copper alloys. The plating bath is suitable in the manufacture of printed circuit boards, IC substrates and the like as well as for metallization of semiconducting and glass substrates.

BACKGROUND OF THE INVENTION

Aqueous acidic plating baths for electrolytic deposition of copper are used for manufacturing printed circuit boards and IC substrates where fine structures like trenches, through holes (TH), blind micro vias (BMV) and pillar bumps need to be filled or build up with copper. Another application of such electrolytic deposition of copper is filling of recessed structures such as through silicon vias (TSV) and dual damascene plating or forming redistribution layers (RDL) and pillar bumps in and on semiconducting substrates. Still another application which is becoming more demanding is filling through glass vias, i.e. holes and related recessed structures in glass substrates with copper or copper alloys by electroplating.

The patent application EP 1 069 211 A2 discloses aqueous acidic copper plating baths comprising a source of copper ions, an acid, a carrier additive, a brightener additive and a leveler additive which can be poly[bis(2-chloroethyl)ether-alt-1,3-bis[3-(dimethylamino)propyl]urea (CAS-No. 68555-36-2) which contains an organo-bound halide atom (e.g., covalent C—Cl bonds) in at least one terminus (see comparative preparation example 1).

Zinc plating baths each containing high amounts of ureylene polymers are disclosed in WO 2011/029781 A1 and US 2009/205969 A1.

EP 2 518 187 A1 teaches a copper plating bath containing a ruthenium based leveller. Such leveler additives in acidic copper plating baths are not suitable to fulfill the current and future requirements in manufacture of advanced printed circuit boards, IC substrates and metallization of semiconducting and glass substrates. Depending on the circuitry layout, BMVs' in printed circuit boards and IC substrates need to be filled with copper completely and not only conformally. Typical requirements for BMV filling are for example: obtaining a completely filled BMV while depositing no more than 10 to 15 μm of copper onto the neighbouring planar substrate areas and at the same time creating a dimple on the outer surface of the filled BMV of no more than 0 to 10 μm.

In metallization of semiconducting wafers, TSV filling must lead to a complete and void-free filling with copper while creating no more than ⅕ of via diameter of overplated copper onto the neighbouring planar areas. Similar requirements are demanded for filling through glass vias with copper.

Objective of the Invention

Thus, it is an objective of the present invention to provide an aqueous acidic copper plating bath for electrolytic deposition of copper or copper alloys which fulfils the requirements for the above mentioned applications, particularly in the field of printed circuit board and/or IC substrate manufacturing, and more particularly in metallisation of semiconducting substrates like TSV filling, dual damascene plating, deposition of redistribution layers or pillar bumping and/or filling of through glass vias.

SUMMARY OF THE INVENTION

This objective is solved with an aqueous acidic copper electroplating bath comprising a source of copper ions, an acid and at least one ureylene polymer selected from polymers according to Formulae (I), (II) and/or (III)

I

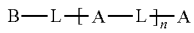

II

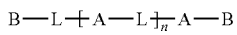

III

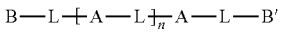

wherein n represents an integer, preferably from 1 to 40, more preferably from 1-10, and A represents a unit derived from a diamino compound of the following Formulae (IV), (V), (VI) and/or (VII)

IV

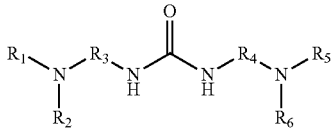

V

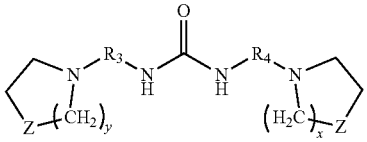

VI

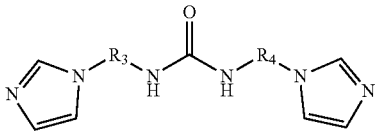

VII

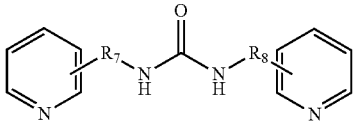

wherein

R1, R2, R5, R6 are independently selected from the group consisting of a substituted or unsubstituted hydrocarbon residue with 1 to 10 carbon atoms, preferably methyl, ethyl, hydroxyethyl or $—CH_2CH_2(OCH_2CH_2)_a—OH$ wherein a is an integer from 0 to 4, preferably 1 to 4, and R3, R4 are independently selected from the group $(CH_2)_p$, wherein p is an integer from 2 to 12, preferably an ethylene or propylene group, or a $—[CH_2CH_2O]_m—CH_2CH_2$-group, wherein m is an integer from 1 to 40, preferably for a —$(CH_2)_2$—O—$(CH_2)_2$— or —$(CH_2)_2$—O$(CH_2)_2$—O—$(CH_2)_2$— group, Z may be the same or different and represents 0 or S, preferably Z is the same, most preferably Z is O, x and y are an integer, may be the same or different, and are preferably an integer selected from 1, 2 and 3, more preferably x and y are both 2, R7 and R8 are independently selected from the group $(CH_2)_p$, wherein p is an integer from 1 to 12, preferably a methylene, ethylene or propylene group, or a —$[CH_2CH_2O]_m$—$CH_2CH_2$— group, wherein m is an integer from 1 to 40, preferably a —$(CH_2)_2$—O—$(CH_2)_2$— or —$(CH_2)_2$—O$(CH_2)_2$—O—$(CH_2)_2$-group, R7, R8 in formula VII may be bound to said pyridyl moiety in meta- or para-position, with respect to the nitrogen atom comprised by the pyridine ring, the single units A may be the same or different, wherein B and B' represent a unit derived from a compound of the following Formulae (VIII), (IX), (X) or (XI)

VIII

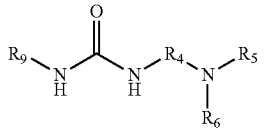

IX

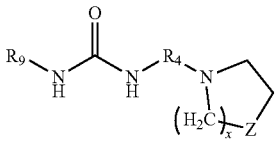

X

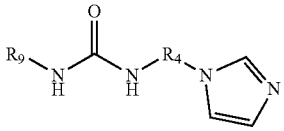

XI

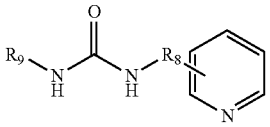

wherein

R5, R6 are independently selected from the group consisting of a substituted or unsubstituted hydrocarbon residue with 1 to 10 carbon atoms, preferably methyl, ethyl, hydroxyethyl or —$CH_2CH_2(OCH_2CH_2)_a$—OH wherein a is an integer from 0 to 4, and R3 is selected from the group $(CH_2)_p$, wherein p is an integer from 2 to 12, preferably an ethylene or propylene group, or a —$[CH_2CH_2O]_m$—$CH_2CH_2$-group, wherein m is an integer from 1 to 40, preferably for a —$(CH_2)_2$—O—$(CH_2)_2$— or —$(CH_2)_2$—O$(CH_2)_2$—O—$(CH_2)_2$— group, Z represents O or S, preferably Z is O, x is an integer, preferably an integer selected from 1, 2 and 3, more preferably x is 2, R7 is selected from the group $(CH_2)_p$, wherein p is an integer from 1 to 12, preferably a methylene, ethylene or propylene group, or a —$[CH_2CH_2O]_m$—$CH_2CH_2$— group, wherein m is an integer from 1 to 40, preferably for a —$(CH_2)_2$—O—$(CH_2)_2$— or —$(CH_2)_2$—O$(CH_2)_2$—O—$(CH_2)_2$— group, wherein R7 in formula XI may be bound to said pyridyl moiety in meta- or para-position, with respect to the nitrogen atom comprised by the pyridine ring, R9 is selected from the group consisting of hydrogen, a substituted or unsubstituted hydrocarbon residue with 1 to 10 carbon atoms, linear or branched, preferably alkyl, more preferably methyl, ethyl, propyl, butyl, pentyl, hexyl, octyl, hydroxyethyl, —$CH_2CH_2(OCH_2CH_2)_a$—OR10, and —$CH_2CH_2(OCH_2CH_2)_a$—$(OCH_2CHCH_3)_b$—OR10, wherein a is an integer from 0 to 10 and b is an integer from 0 to 10 and R10 is selected from the group of a substituted or unsubstituted hydrocarbon residue with 1 to 10 carbon atoms, linear or branched, preferably methyl, ethyl, propyl, butyl, pentyl, hexyl, octyl, hydroxyethyl, or wherein R9 and/or R10 are selected from the group consisting of an aryl or alkaryl residue, which may be substituted or unsubstituted, preferably substituted or unsubstituted phenyl or benzyl, and which may contain one or more heteroatoms, preferably N, S or O, wherein the single units B may be the same or different, and wherein B and B' are different, wherein L is a divalent unit, which is selected from the group consisting of

XII

—$R_{11}$— and

XIII

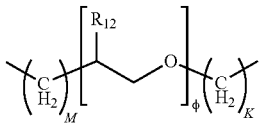

wherein

R11 is selected from the group consisting of alkylene —$(CH_2)_c$—, wherein c is an integer from 2 to 10, preferably 2 to 6, and xylenyl, each R12 is independently from each other selected from the group consisting of hydrogen, alkyl, aryl, alkaryl, M is an integer from 0 to 3, ϕ is an integer ranging from 1 to 100, and K is an integer ranging from 1 to 3, wherein the single units L may be the same or different.

Recessed structures such as trenches, blind micro vias (BMVs'), through silicon vias (TSVs') and through glass vias can be filled with copper deposited from the aqueous acidic copper plating bath according to the present invention. The copper filled recessed structures are preferably void free, or at least comprise less voids, and have an acceptable dimple, i.e., a planar or almost planar surface. Furthermore, the build-up of pillar bump structures is feasible.

With the ureylene polymers of this invention, uniform reaction products are obtained and, in principle, a hydrophobic group (e.g. hexyl group or an aromatic group) can also be introduced at both polymer or oligomer ends. This has been shown to gain benefits in copper plating which are shown in the examples, particularly better filling of BMV.

DETAILED DESCRIPTION OF THE INVENTION

In the following description an "ureylene polymer" is also designated as "polymer".

Polymers according to Formula (I) have a units B at one end of the polymer chain, the polymers according to Formula (II) have units B at both ends of the polymer chain and the polymers according to Formula (III) have a unit B at one end and a unit B' at the other end of the polymer chain, wherein B and B' are selected from a compound of Formulae (VIII), (IX), (X) or (XI), and wherein B and B' are different.

Since B and B' both represent a unit derived from a compound of the Formulae (VIII), (IX), (X) or (XI), a polymer having B' at both ends is equivalent to a polymer having B at both ends, i.e. a polymer according to Formula (II).

If one or more of R1, R2, R5 or R6 is a substituted hydrocarbon residue, it is preferably substituted with $C_1$-$C_6$ alkyl (linear or branched, preferably —$CH_3$, —$CH_2CH_3$), aryl (preferably phenyl) or aralkyl (preferably benzyl).

In a preferred embodiment, R1, R2, R5 and R6 in Formula (IV) are independently selected from the group consisting of methyl, ethyl, hydroxyethyl, and —$CH_2CH_2(OCH_2CH_2)_a$—OH, wherein a is an integer from 1 to 4.

In a preferred embodiment, R5 and R6 in Formula (VIII) are independently selected from the group consisting of methyl, ethyl, hydroxyethyl, and —$CH_2CH_2(OCH_2CH_2)_a$—OH, wherein a is an integer from 1 to 4.

In a preferred embodiment, R3 and R4 in Formulae (IV), (V), and/or (VI) are independently selected from the group consisting of ethylene, propylene, —$(CH_2)_2$—O—$(CH_2)_2$—, and —$(CH_2)_2$—O—$(CH_2)_2$—O—$(CH_2)_2$—.

In a preferred embodiment, R3 in Formulae (VIII), (IX), and/or (X) is selected from the group consisting of ethylene, propylene, —$(CH_2)_2$—O—$(CH_2)_2$—, and —$(CH_2)_2$—O—$(CH_2)_2$—O—$(CH_2)_2$—.

In a preferred embodiment, R7 and R8 in Formula (VII) are independently selected from the group consisting of a methylene group, an ethylene group, a propylene group, a —$(CH_2)_2$—O—$(CH_2)_2$— group, or a —$(CH_2)_2$—O$(CH_2)_2$—O—$(CH_2)_2$— group.

In a preferred embodiment, R7 in Formula (XI) is selected from the group consisting of a methylene group, an ethylene group, a propylene group, a —$(CH_2)_2$—O—$(CH_2)_2$— group, or a —$(CH_2)_2$—O$(CH_2)_2$—O—$(CH_2)_2$— group.

In a preferred embodiment, R9 and/or R10 in Formulae (VIII), (IX), (X) and/or (XI) are independently selected from methyl, ethyl, propyl, butyl, pentyl, hexyl, octyl, wherein R9 and/or R10 may be linear or, if possible, branched, hydroxyethyl, phenyl, or benzyl.

The term "polymer" has to be understood in a broad sense in connection with the present invention. It comprises any compounds of Formulae (I), (II) or (III), wherein n=1.

The term "polymer" does comprise, in particular, compounds which are typically designated as oligomers, for example compounds of Formulae (I), (II) or (III) wherein n is 1 to 5.

The ureylene polymer of Formulae (I), (II) and (III) can be obtained by reacting one or more diamino compounds of Formulae (IV), (V), (VI) and/or (VII) with one or more compounds of the following Formulae (XIIa) or (XIIIa), XIIa $$LG—R_{11}—LG$$

XIIIa

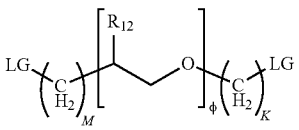

wherein LG in Formula XIIa or in Formula XIIIa may be the same or different, and is a leaving group which may be replaced, in a substitution reaction, by an N-atom of a compound of the Formulae (IV), (V), (VI) or (VII), or by an N-atom of a compound of the Formulae (VIII), (IX), (X) or (XI). In such substitution reaction, polymers of Formulae (I), (II), and/or (III) are formed.

In the polymers, the linkages between units A und L, or B and L (or B' and L) occur via quaternary ammonium groups, which are formed linking the divalent residue L with the tertiary amino groups of the compounds of the Formulae (IV), (V), (VIII) or (IX), or via imidazoyl moieties,

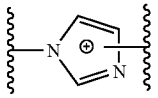

which are formed linking the divalent residue L with the tertiary amino groups of the compounds of the Formulae (VI) or (X), or via pyridyl moieties

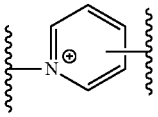

which are formed linking the divalent residue L with the nitrogen in the pyridine ring of the compounds of the Formulae (VII) or (XI).

The polymers are positively charged ureylene polymers and counterions $LG^-$ are present.

Preferably, LG is selected from a halogen or pseudohalogen, preferably from mesylate, triflate, nonaflate, alkylsulfonate, such as methanesulfonate, arylsulfonate, tosylate, or halide, preferably Cl or Br.

The kind of polymer obtained can be steered mainly by following parameters:

i) a molar ratio of molar ratio ($n_A$:$n_L$) of the total amount of substance used of the compound(s) of Formulae (IV), (V), (VI) and/or (VII) ($n_A$), the precursor of unit(s) A in the polymer, to the total amount of substance of the compound(s) of Formulae (XIIa) and/or (XIIIa) ($n_L$), the precursor of unit(s) L in the polymer, ii) a molar ratio of molar ratio ($n_A$:$n_B$) of the total amount of substance used of the compound(s) of Formulae (IV), (V), (VI) and/or (VII) ($n_A$), the precursor of unit(s) A in the polymer, to the total amount of substance of the compound(s) of Formulae (VIII), (IX), (X) or (XI) ($n_B$), the precursor of (end) unit(s) B or B' in the polymer, iii) when choosing at least two of compound(s) of Formulae (VIII), (IX), (X) or (XI): a molar ratio ($n_B$:$n_{B'}$) of a first compound of Formula (IV), (V), (VI) or (VII) ($n_B$) to a second compound of Formula (IV), (V), (VI) or (VII) ($n_{B'}$), wherein the second compound is different from the first compound.

Parameter i) influences for example the (average) chain length and (average (molar mass) of the polymer, or the structure of an intermediate polymer as shown below.

Parameter ii) influences for example the ratio between polymer (I) and polymer (II). The higher $n_B$ in relation to $n_A$, the more of polymer (II) is formed.

Parameter iii) influences for example the ratio between polymer (II) and polymer (III). Equal $n_{B'}$ in relation to $n_B$ promotes formation of polymer (III).

In methods for producing the polymers, the molar ratio ($n_A$:$n_L$) of the total amount of substance used of the compound(s) of Formulae (IV), (V), (VI) and/or (VII) ($n_A$) to the total amount of substance of the compound(s) of Formulae (XIIa) and/or (XIIIa) ($n_L$) is preferably in the range of 1:2 to 1:1.

In methods for producing the polymers, the molar ratio ($n_A$:$n_B$) of the total amount of substance used of the compound(s) of Formulae (IV), (V), (VI) and/or (VII) ($n_A$) to the total amount of substance of the compound(s) of Formulae (VIII), (IX), (X) or (XI) ($n_B$) is preferably in the range of 1:1 to 3:1.

These molar ratios are preferably used in non sequential methods, when for example compound(s) of Formulae (IV), (V), (VI) and/or (VII) (precursor of unit A) and compound(s) of Formulae (VIII), (IX), (X) or (XI) (precursor of unit B, B') are added to a compound of Formulae (XIIa) and/or (XIIIa) (or added vice versa, as shown in examples).

These ways for obtaining polymers (I), (II) and (III) are not to be understood as exhaustive. For example, sequential methods are possible, wherein in a first step an intermediate polymer composed of units A and L is formed and in a second step such intermediate polymer is reacted with B, or with B and B'.

The ureylene polymers of Formula (I) can be obtained by reacting one or more diamino compounds of Formulae (IV), (V), (VI) and/or (VII) (molar amount $n_A$) with one or more compounds of Formulae (XIIa) and/or (XIIIa) (molar amount $n_L$) wherein the molar ratio ($n_A$:$n_L$) of the total amount of substance used of the compound(s) of Formulae (IV), (V), (VI) and/or (VII) ($n_A$) to the total amount of substance of the compound(s) of Formulae (XIIa) and/or (XIIIa) ($n_L$) is 1:1 The intermediate polymers obtained have the Formula (XIV), wherein n represents an integer, preferably from 1 to 40, more preferably from 1-10.

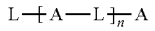

(XIV)

The ureylene polymers according to Formula (VIX) is further reacted with a compound according to Formula (VIII), (IX), (X) or (XI) in order to obtain an ureylene polymer according to Formula (I).

The ureylene polymers according to Formula (II) can be obtained by reacting one or more diamino compounds of Formulae (IV), (V), (VI) and/or (VII) (molar amount $n_A$) with one or more compounds of Formulae (XIIa) and/or (XIIIa) (molar amount $n_L$) wherein the molar ratio ($n_A$:$n_L$) of the total amount of substance used of the compound(s) of Formulae (IV), (V), (VI) and/or (VII) ($n_A$) to the total amount of substance of the compound(s) of Formulae (XIIa) and/or (XIIIa) ($n_L$) is at least 1:1.1, more preferably at least 1:1.3, and most preferably at least 1:1.5. The intermediate polymers obtained have the Formula (XV), wherein n represents an integer, preferably from 1 to 40, more preferably from 1-10.

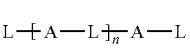

(XV)

The intermediate ureylene polymer according to Formula (XV) is further reacted with one compound according to Formula (VIII), (IX), (X) or (XI) in order to obtain an ureylene polymer according to Formula (II), or with two different compounds according to Formula (VIII), (IX), (X) or (XI) in order to obtain an ureylene polymer according to Formula (III).

The ureylene polymers of the Formulae (I), (II) and (III) preferably have a weight average molecular mass Mw of 1000 to 20000 Da, more preferably of 2000 to 15000 Da.

The reaction for forming the ureylene polymers may preferably be carried out in aqueous or aqueous-alcoholic solutions or solvent-free substances at temperatures of preferably 20 to 100° C.

The ureylene polymers of the Formulae (I), (II) and (III) preferably do not contain any organically bound halogen, such as a covalent C—Cl moiety.

The concentration of the at least one ureylene polymer according to Formulae (I), (II) and/or (III) in the aqueous acidic copper plating bath preferably ranges from 0.001 mg/l to 200 mg/l, more preferably from 0.005 mg/l to 100 mg/l and most preferably from 0.01 mg/l to 50 mg/l.

The term acidic means a pH value of lower than 7. The aqueous acidic copper plating bath preferably has a pH value of ≤2, more preferably of ≤1.

The aqueous acidic copper plating bath further contains at least one source of copper ions which is preferably selected from the group comprising copper sulfate and copper alkyl sulfonates such as copper methane sulfonate. The copper ion concentration in the aqueous acidic copper plating bath preferably ranges from 4 g/l to 90 g/l.

The aqueous acidic copper plating bath further contains at least one source of acid which is preferably selected from the group comprising sulfuric acid, fluoro boric acid, phosphoric acid and methane sulfonic acid and is preferably added in a concentration of 10 g/l to 400 g/l, more preferably from 20 g/l to 300 g/l.

The aqueous acidic copper plating bath preferably further contains at least one accelerator-brightener additive which is selected from the group consisting of organic thiol-, sulfide-, disulfide- and polysulfide-compounds. Preferred accelerator-brightener additives are selected from the group comprising 3-(benzthiazolyl-2-thio)-propylsulfonic-acid, 3-mercaptopropan-1-sulfonic-acid, ethylendithiodipropylsulfonic-acid, bis-(ω-sulfophenyl)-disulfide, bis-(ω-sulfobutyl)-disulfide, bis-(ω-sulfohydroxypropyl)-disulfide, bis-(ω-sulfopropyl)-disulfide, bis-(ω-sulfopropyl)-sulfide, methyl-(ω-sulfopropyl)-disulfide, methyl-(ω-sulfopropyl)-trisulfide, O-ethyl-dithiocarbonic-acid-S-(ω-sulfopropyl)-ester, thioglycol-acid, thiophosphoric-acid-O-ethyl-bis-(ω-sulfopropyl)-ester, thiophosphoric-acid-tris-(ω-sulfopropyl)-ester and their corresponding salts. The concentration of all accelerator-brightener additives optionally present in the aqueous acidic copper bath preferably ranges from 0.01 mg/l to 100 mg/l, more preferably from 0.05 mg/l to 10 mg/l.

The aqueous acidic copper plating bath optionally further contains at least one carrier-suppressor additive which is preferably selected from the group comprising polyvinylalcohol, carboxymethylcellulose, polyethylenglycol, polypropylenglycol, stearic acid polyglycolester, alkoxylated naphthols, oleic acid polyglycolester, stearylalcoholpolyglycolether, nonylphenolpolyglycolether, octanolpolyalkylenglycolether, octanediol-bis-(polyalkylenglycolether), poly(ethylenglycol-ran-propylenglycol), poly(ethylenglycol)-block-poly(propylenglycol)-block-poly(ethylenglycol), and poly(propylenglycol)-block-poly(ethylenglycol)-block-poly(propylenglycol). More preferably, the optional carrier-suppressor additive is selected from the group comprising polyethylenglycol, polypropylenglycol, poly(ethylenglycol-ran-propylenglycol), poly(ethylenglycol)-block-poly(propylenglycol)-block-poly(ethylenglycol), and poly(propylenglycol)-block-poly(ethylenglycol)-block-poly(propylenglycol). The concentration of said optional carrier-suppressor additive preferably ranges from 0.005 g/l to 20 g/l, more preferably from 0.01 g/l to 5 g/l.

Optionally, the aqueous acidic copper plating bath contains in addition to the ureylene polymer according to Formulae (I), (II) or (III) at least one further leveler additive selected from the group comprising nitrogen containing organic compounds such as polyethyleneimine, alkoxylated polyethyleneimine, alkoxylated lactames and polymers thereof, diethylenetriamine and hexamethylenetetramine, organic dyes such as Janus Green B, Bismarck Brown Y and Acid Violet 7, sulphur containing amino acids such as cysteine, phenazinium salts and derivatives thereof. The preferred further leveler additive is selected from nitrogen containing organic compounds. Said optional leveler additive is added to the aqueous acidic copper plating bath in amounts of 0.1 mg/l to 100 mg/l.

The aqueous acidic copper plating bath optionally further contains at least one source of halogenide ions or halogenide ions, preferably chloride ions, preferably in a quantity of 20 mg/l to 200 mg/l, more preferably from 30 mg/l to 60 mg/l. Suitable sources for halogenide ions are for example alkali halogenides such as sodium chloride.

The optional halogenide ions may be provided solely or partly by the ureylene polymer according to Formulae (I), (II) or (III) when the counter ions are halogenide ions.

In another aspect, the invention provides a method for deposition of copper onto a substrate comprising, in this order, the steps:

a. providing a substrate and
b. contacting the substrate with an aqueous acidic copper electroplating bath as described before,
c. applying an electrical current between the substrate and at least one anode, and thereby depositing copper onto the substrate.

The substrate may be selected from the group comprising printed circuit boards, IC substrates, semiconducting wafers and glass substrates.

Copper may be deposited into recessed structures selected from the group comprising of trenches, blind micro vias, through silicon vias and through glass vias.

The aqueous acidic copper plating bath is preferably operated in the method according to the present invention in a temperature range of 15° C. to 50° C., more preferably in a temperature range of 25° C. to 40° C. by applying an electrical current to the substrate and at least one anode. Preferably, a cathodic current density range of 0.0005 A/dm$^2$ to 12 A/dm$^2$, more preferably 0.001 A/dm$^2$ to 7 A/dm$^2$ is applied.

The plating bath according to the present invention can be used for DC plating and reverse pulse plating. Both inert and soluble anodes can be utilised when depositing copper from the plating bath according to the present invention.

In one embodiment of the present invention, a redox couple, such as $Fe^{2+/3+}$ ions is added to the plating bath. Such a redox couple is particularly useful, if reverse pulse plating is used combination with inert anodes for copper deposition. Suitable processes for copper plating using a redox couple in combination with reverse pulse plating and inert anodes are for example disclosed in U.S. Pat. Nos. 5,976,341 and 6,099,711.

The aqueous acidic copper plating bath can be either used in conventional vertical or horizontal plating equipment.

The aqueous acidic copper plating bath according to the present invention is essentially free of zinc ions. "Essentially free" is defined herein as "not intentionally added". "not intentionally added" means that the bath is free of zinc ions, but may contain very small amount of zinc ions which were inserted as polution. Hence, the aqueous acidic copper plating bath according to the present invention does contain less than 2 ppm zinc ions, preferably less than 0.5 ppm zinc ions or does not contain zinc ions.

The metal layer obtained by electroplating from said aqueous acidic copper plating bath is a copper or copper alloy layer. Accordingly, zinc and zinc alloy layers are not obtainable from said aqueous acidic copper plating bath because the bath does not contain zinc ions.

The invention will now be illustrated by reference to the following non-limiting examples.

EXAMPLES

The weight average molecular mass Mw of the ureylene polymers was determined by gel permeation chromatography (GPC) using a GPC apparatus from SECurity GPC System PSS equipped with RI Detector and a Agilent 1260 pump, a Tosoh TSK 2500+3000 column, and Pullulan and PEG standards with Mw=400 to 40000 g/mol. The solvent used was Millipore water with 0.5% acetic acid and 0.1 M $Na_2SO_4$.

1. Preparation of Ureylene Polymers 1.1 Manufacturing Example 1

23.04 g (100 mmol) of 1,3-bis (3-(dimethylaminopropyl) urea and 4.84 g (33.33 mmol) of 1-(3-(dimethylaminopropyl) urea) were dissolved in 61 ml of distilled water and dissolved and heated to 80° C. within 10 minutes. After obtaining a clear solution, 32.2 g (100 mmol) of triethylene glycol dimesylate were added dropwise within one hour and the mixture was stirred for 10 hours at 80° C. The reaction mixture was then cooled to 25° C.

1.2 Manufacturing Example 2

5.61 g (33.33 mmol) of 1-(3-(1H-imididazol-1yl) propylurea and 27.63 g (100 mmol) of 1,3-bis(3-(1H-imidazol-1-yl) propylurea were dissolved in 67 ml of distilled water and heated within 10 minutes to 80° C. After obtaining a clear solution, 32.2 g (100 mmol) of triethylene glycol dimesylate were added dropwise within 43 minutes and the mixture was stirred for a further 93 hours at 80° C. The reaction mixture was then stirred and cooled to 25° C.

127.8 g of an aqueous orange polymer solution (48.3% by weight) were obtained. (Mw=1150 Da).

1.3 Manufacturing Example 3

2.52 g (16.67 mmol) of 1-(pyridin-3-ylmethyl) urea and 12.11 g (50 mmol) of 1,3-bis(pyridin-3-ylmethyl) urea were dissolved in 29 mL of distilled water and heated to 80° C. within 10 minutes. After a clear solution had been obtained, 16.12 g (50 mmol) of triethylene glycol dimesylate were added dropwise in the course of 7 minutes and the mixture was stirred at 80° C. for a further 20 hours. The reaction mixture was then cooled to 25° C.

60 g of an aqueous orange polymer solution (51.8% by weight) were obtained. (Mw=1580 Da).

1.4 Manufacturing Example 4

13.79 g (59.9 mmol) 1,3-bis (3-(dimethylaminopropyl) urea and 8.70 g (59.9 mmol) 1-(3-(dimethylaminopropyl) urea were dissolved in 47.3 mL distilled water and heated within 10 minutes to 80° C. After a clear solution had been obtained, 29 g (90 mmol) of triethylene glycol dimesylate were added dropwise over the course of an hour and the mixture was stirred for 10 hours at 80° C. The reaction mixture was then cooled to 25° C. 100 g of an aqueous orange polymer solution (51.3% by weight) were obtained. (Mw=1130 Da).

1.5 Manufacturing Example 5

7.51 g (32.6 mmol) of 1,3-bis (3-(dimethylaminopropyl) urea and 2.49 g (10.87 mmol) of 1-(3-(dimethylaminopropyl)-3-hexylurea were dissolved in 20 mL of distilled water and heated within 10 minutes to 80° C. After obtaining a clear solution, 10.5 g (32.6 mmol) of triethylene glycol dimesylate were added dropwise within 32 minutes and the mixture was stirred for 5 hours at 80° C. The reaction mixture was then cooled to 25° C. 40 g of an aqueous orange polymer solution (49.9% by weight) were obtained. (Mw=1510 Da).

1.6 Manufacturing Example 6

7.55 g (32.8 mmol) of 1,3-bis (3-(dimethylaminopropyl) urea and 2.42 g (10.87 mmol) of 1-(3-(dimethylaminopropyl)-3-phenylurea were dissolved in 20 mL of distilled water and heated within 10 minutes to 80° C. After obtaining a clear solution, 10.6 g (32.8 mmol) of triethylene glycol dimesylate were added dropwise within 12 minutes and the mixture was stirred for 5 hours at 80° C. The reaction mixture was then cooled to 25° C.

40 g of an aqueous orange polymer solution (49.3% by weight) were obtained. (Mw=1390 Da).

1.7 Manufacturing Example 7

5.06 g (21.95 mmol) of 1,3-bis (3-(dimethylaminopropyl) urea and 4.86 g (21.95 mmol) of 1-(3-(dimethylaminopropyl)-3-phenylurea were dissolved in 20 mL of distilled water and heated within 10 minutes to 80° C. After obtaining a clear solution, 10.62 g (32.9 mmol) of triethylene glycol dimesylate were added dropwise within 9 minutes and the mixture was stirred for 5 hours at 80° C. The reaction mixture was then cooled to 25° C.

40 g of an aqueous orange polymer solution (47.9% by weight) were obtained. (Mw=1250 Da).

2. Application Examples

Equipment: Mini Sparger Cell with 2.5 l volume, bath agitation with a pump, no air injection, titan anode coated with iridium oxide.

A copper plating bath stock solution comprising 60 g/l $Cu^{2+}$ ions (added as copper sulfate), 50 g/l sulfuric acid, 45 mg/l $Cl^-$ ions, 300 mg/l polyethylenglycol as a carrier-suppressor additive and 1.0 ml/l of a solution containing an organic brightener additive was used. The ureylene polymers were added to said stock solution (application examples 1 to 6).

A current density of 1.9 A/dm$^2$ was applied throughout application examples 1 to 6. The thickness of copper plated onto the top surface of the substrate was in average 15 μm. The plating time was 45 min. The test panels were cleaned and rinsed prior to electroplating of copper.

The test panels used throughout application examples 1 to 6 comprised BMVs (depth×diameter: 70×75 μm and 70×100). The size of the test panels was 8.6×9.6 cm.

Comparative Examples

Mirapol WT® (Solvay Company) is a polymer from N,N'-bis[3-(dimethylamino)propyl]-urea with 1,1'-oxybis[2-chloroethane]

The inventive examples show significantly better results than the Mirapol WT® in that the inventive examples lead to a dimple of lower depth.

Results are shown in the following tables.

TABLE 1

| Ureylene Polymer/ Leveler | Application example | Ureylene Polymer Formula | Monomer A |
|---|---|---|---|
| Example 1 | 1 | I | 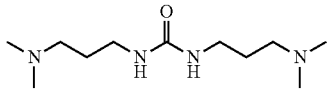 |
| Example 2 | 2 | I | 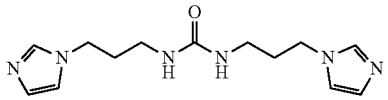 |
| Example 3 | 3 | I | 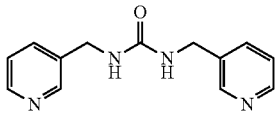 |
| Example 4 | 4 | II | 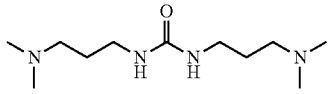 |
| Example 5 | 5 | I | 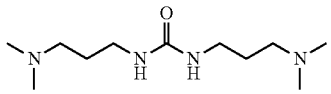 |

TABLE 1-continued

| | | | |
|---|---|---|---|
| Example 6 | 6 | I | 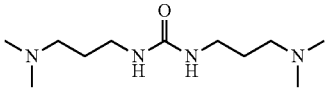 |
| Example 7 | 7 | II | 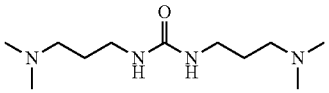 |
| Mirapol WT ® (comparative example) | — | — | 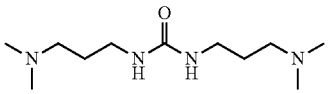 |

| | Ureylene Polymer/ Leveler | Monomer B | Monomer L |
|---|---|---|---|
| | Example 1 | 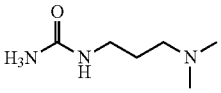 | 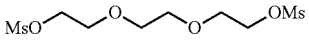 |
| | Example 2 | 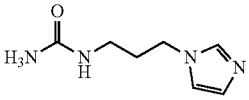 | 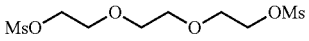 |
| | Example 3 | 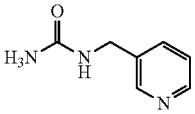 | 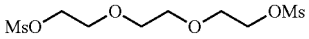 |
| | Example 4 | 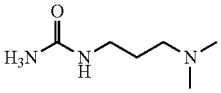 | 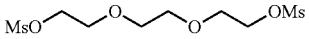 |
| | Example 5 | 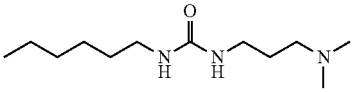 | 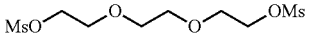 |
| | Example 6 | 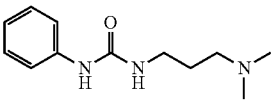 | 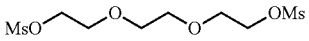 |
| | Example 7 | 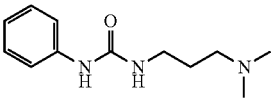 | 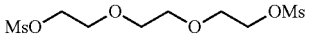 |
| | Mirapol WT ® (comparative example) | — | 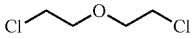 |

TABLE 2

| Ureylene Polymer/Leveler | Application example | Ureylene Polymer Formula | Dimple depth (μm) (Leveler 5 mg/l) at BMV diameter | | Dimple depth (μm) (Leveler 10 mg/l) at BMV diameter | |
|---|---|---|---|---|---|---|
| | | | BMV 75 μm | BMV 100 μm | BMV 75 μm | BMV 100 μm |
| Example 1 | 1 | I | 5 | 10 | 4 | 11 |
| Example 2 | 2 | I | 5 | 8 | 4 | 10 |
| Example 3 | 3 | I | 6 | 12 | 8 | 14 |
| Example 4 | 4 | II | 5 | 8 | 5 | 8 |
| Example 5 | 5 | I | 2 | 5 | 2 | 5 |
| Example 6 | 6 | I | 1 | 4 | 1 | 3 |
| Example 7 | 7 | II | 4 | 6 | 4 | 7 |

TABLE 2-continued

| Ureylene Polymer/Leveler | Application example | Ureylene Polymer Formula | Dimple depth (μm) (Leveler 5 mg/l) at BMV diameter | | Dimple depth (μm) (Leveler 10 mg/l) at BMV diameter | |
|---|---|---|---|---|---|---|
| | | | BMV 75 μm | BMV 100 μm | BMV 75 μm | BMV 100 μm |
| Mirapol WT ® (comparative example 2 EP 1069211 A2) | — | — | 21 | 41 | 22 | 44 |

The invention claimed is:

1. An aqueous acidic copper electroplating bath comprising a source of copper ions, an acid and at least one ureylene polymer selected from polymers according to Formulae (I), (II) and/or (III)

I

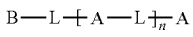

II

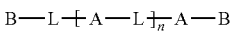

III

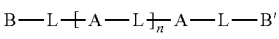

wherein n represents an integer from 1 to 40, and

A represents a unit derived from a diamino compound of the following Formulae (IV), (V), (VI) and/or (VII)

IV

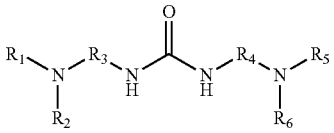

V

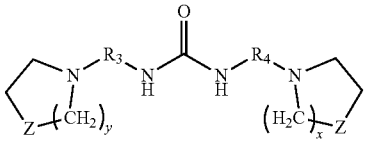

VI

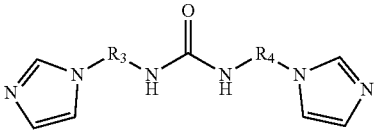

VII

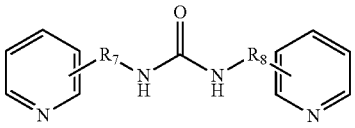

wherein

R1, R2, R5, R6 are independently selected from the group consisting of a substituted or unsubstituted hydrocarbon residue with 1 to 10 carbon atoms, or —$CH_2CH_2(OCH_2CH_2)_a$—OH, wherein a is an integer from 0 to 4, and R3, R4 are independently selected from the group $(CH_2)_p$, wherein p is an integer from 2 to 12, or a —$[CH_2CH_2O]_m$—$CH_2CH_2$— group, wherein m is an integer from 1 to 40, Z may be the same or different and represents O or S, x and y are an integer, and may be the same or different, R7 and R8 are independently selected from the group $(CH_2)_p$, wherein p is an integer from 1 to 12, or a —$[CH_2CH_2O]_m$—$CH_2CH_2$— group, wherein m is an integer from 1 to 40, wherein R7, R8 in formula VII may be bound to said pyridyl moiety in meta- or para-position, with respect to the nitrogen atom comprised by the pyridine ring, the single units A may be the same or different, wherein B and B' represent a unit derived from a compound of the following Formulae (VIII), (IX), (X) or (XI)

VIII

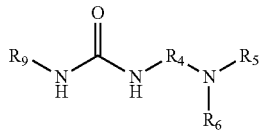

IX

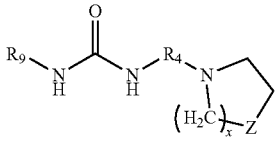

X

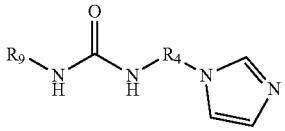

XI

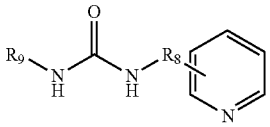

wherein

R5, R6 are independently selected from the group consisting of a substituted or unsubstituted hydrocarbon residue with 1 to 10 carbon atoms, and —$CH_2CH_2(OCH_2CH_2)_a$—OH wherein a is an integer from 0 to 4, and R3 is selected from the group $(CH_2)_p$, wherein p is an integer from 2 to 12, or a —$[CH_2CH_2O]_m$—$CH_2CH_2$— group, wherein m is an integer from 1 to 40, Z represents O or S, x is an integer, R7 is selected from the group $(CH_2)_p$, wherein p is an integer from 1 to 12, or a —$[CH_2CH_2O]_m$—$CH_2CH_2$— group, wherein m is an integer from 1 to 40, wherein R7 in formula XI may be bound to said pyridyl moiety in meta- or para-position, with respect to the nitrogen atom comprised by the pyridine ring, R9 is selected from the group consisting of hydrogen, a substituted or unsubstituted hydrocarbon residue with 1 to 10 carbon atoms, linear or branched, $—CH_2CH_2(OCH_2CH_2)_a—OR10$ and $—CH_2CH_2(OCH_2CH_2)_a—(OCH_2CHCH_3)_b—OR10$, wherein a is an integer from 0 to 10 and b is an integer from 0 to 10, and R10 is selected from the group of a substituted or unsubstituted hydrocarbon residue with 1 to 10 carbon atoms, linear or branched, or wherein R9 or R10 are selected from the group consisting of an aryl or alkaryl residue, which may be substituted or unsubstituted, and which may contain one or more heteroatoms, wherein B and B' are different, wherein L is a divalent unit, which is selected from the group consisting of

XII $—R_{11}—$ and

XIII

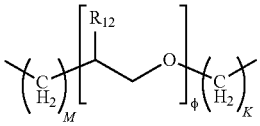

wherein

R11 is selected from the group consisting of alkylene $—(CH_2)_c—$, wherein c is an integer from 2 to 10, and xylenyl, each R12 is independently from each other selected from the group consisting of hydrogen, alkyl, aryl, alkaryl, M is an integer from 0 to 3, ϕ is an integer ranging from 1 to 100, and K is an integer ranging from 1 to 3, wherein the single units L may be the same or different, wherein one or more diamino compounds of Formulae (IV), (V), (VI) and/or (VII) are reacted with one or more compounds of the following Formulae (XIIa) or (XIIIa), XIIa $LG—R_{11}—LG$ or XIIIa

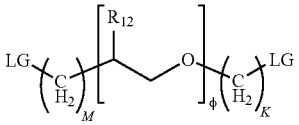

wherein LG in Formula XIIa or in Formula XIIIa may be the same or different, and is a leaving group which may be replaced, in a substitution reaction, by an N-atom of a compound of the Formulae (IV), (V), (VI) or (VII), or by an N-atom of a compound of the Formulae (VIII), (IX), (X) or (XI).

2. The aqueous acidic copper electroplating bath according to claim 1 wherein in Formula (IV) R1, R2, R5 and R6 are independently selected from the group consisting of methyl, ethyl, hydroxyethyl, and $—CH_2CH_2(OCH_2CH_2)_a—OH$, wherein a is an integer from 1 to 4, and/or wherein in Formula (VIII) R5 and R6 are independently selected from the group consisting of methyl, ethyl, hydroxyethyl, and $—CH_2CH_2(OCH_2CH_2)_a—OH$, wherein a is an integer from 1 to 4.

3. The aqueous acidic copper electroplating bath according to claim 1 wherein in Formulae (IV), (V), and/or (VI) R3 and R4 are independently selected from the group consisting of ethylene, propylene, $—(CH_2)_2—O—(CH_2)_2—$, and $—(CH_2)_2—O—(CH_2)_2—O—(CH_2)_2—$ and/or wherein in Formulae (VIII), (IX), and/or (X) R3 is selected from the group consisting of ethylene, propylene, $—(CH_2)_2—O—(CH_2)_2—$, and $—(CH_2)_2—O—(CH_2)_2—O—(CH_2)_2—$.

4. The aqueous acidic copper electroplating bath according to claim 1 wherein in Formula (VII) R7 and R8 are independently selected from the group consisting of a methylene group, an ethylene group, a propylene group, a $—(CH_2)_2—O—(CH_2)_2—$ group, or a $—(CH_2)_2—O(CH_2)_2—O—(CH_2)_2—$ group and/or wherein in Formula (XI) R7 is selected from the group consisting of a methylene group, an ethylene group, a propylene group, a $—(CH_2)_2—O—(CH_2)_2—$ group, or a $—(CH_2)_2—O(CH_2)_2—O—(CH_2)_2—$ group.

5. The aqueous acidic copper electroplating bath according to claim 1 wherein in Formulae (VIII), (IX), (X) and/or (XI) R9 and/or R10 are independently selected from methyl, ethyl, propyl, butyl, pentyl, hexyl, octyl, hydroxyethyl, phenyl, or benzyl.

6. The aqueous acidic copper electroplating bath according to claim 1 wherein the ureylene polymers according to Formulae (I), (II) and (III) do not have covalently C-bound halogen.

7. The aqueous acidic copper electroplating bath according to claim 1 wherein said aqueous acidic copper electroplating bath is free of intentionally added zinc ions.

8. The aqueous acidic copper electroplating bath according to claim 1 wherein the ureylene polymer of Formulae (I), (II) and (III) has a weight average molecular mass Mw in the range of 1000 to 20000 Da.

9. The aqueous acidic copper electroplating bath according to claim 1 wherein the concentration of the ureylene polymer according to Formulae (I), (II) and/or (III) ranges from 0.001 mg/l to 200 mg/l.

10. The aqueous acidic copper electroplating bath according to claim 1 wherein the aqueous acidic copper electroplating bath further comprises a source of halogenide ions, or halogenide ions.

11. The aqueous acidic copper electroplating bath according to claim 10 wherein concentration of halogenide ions ranges from 20 mg/l to 200 mg/l.

12. The aqueous acidic copper electroplating bath according to claim 1 wherein the aqueous acidic copper electroplating bath further comprises an accelerator-brightener additive selected from organic thiol-, sulfide-, disulfide- and polysulfide-compounds.

13. A method for deposition of copper onto a substrate comprising, in this order, the steps a. providing a substrate and b. contacting the substrate with an aqueous acidic copper electroplating bath according to claim 1, c. applying an electrical current between the substrate and at least one anode, and thereby depositing copper onto the substrate.

14. The method for deposition of copper onto a substrate according to claim 13 wherein the substrate is selected from printed circuit boards, IC substrates, semiconducting wafers and glass substrates.

15. The method for deposition of copper onto a substrate according to claim 14 wherein copper is deposited into recessed structures selected from trenches, blind micro vias, through silicon vias and through glass vias.

* * * * *